US006213817B1

(12) United States Patent
Jeong et al.

(10) Patent No.: US 6,213,817 B1
(45) Date of Patent: Apr. 10, 2001

(54) COMPLIANT PRESS-FIT PIN HAVING COMPLIANT CANTILEVER BEAM

(75) Inventors: Myung Yung Jeong; Seung Ho Ahn; Sang Kuk Choi; Dong Pil Shin; Tae Goo Choy, all of Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 09/465,757

(22) Filed: Dec. 17, 1999

(30) Foreign Application Priority Data

Nov. 3, 1999 (KR) ..... 99-48349

(51) Int. Cl.[7] ..... H01R 13/42
(52) U.S. Cl. ..... 439/751
(58) Field of Search ..... 439/751, 82, 84, 439/873, 83

(56) References Cited

U.S. PATENT DOCUMENTS 3,846,741 * 11/1974 Kunkle et al. ..... 330/221
4,186,982 2/1980 Cobaugh et al. ..... 339/17
4,897,053 * 1/1990 Verhoven et al. ..... 439/751
5,564,954 * 10/1996 Wurster ..... 439/751
5,738,550 4/1998 Sakuraoka et al. ..... 439/751
5,743,769 * 4/1998 Koguchi ..... 439/751

OTHER PUBLICATIONS

Tsuneo Kanai et al., "Design of Compliant Press–Fit Pin Connection", IEEE Transactions of Components, Hybrids, and Manufacturing Technology, vol. CHMT–8, No. 1, Mar. 1985.

* cited by examiner

*Primary Examiner*—Gary F. Paumen
*Assistant Examiner*—Alexander Gilman
(74) *Attorney, Agent, or Firm*—Jacobson, Price, Holman & Stern, PLLC

(57) ABSTRACT

A compliant press-fit pin for electrically coupling a first board to a second board via a plated through hole formed in the second board, includes: an upper part for electrically fixing the first board; a lower part for electrically coupling the first board to a third board via the plated through hole formed in the second board; and a press-fit part located between said upper part and said lower part and containing a fixed beam and a compliant cantilever beam, for electrically coupling the first board fixed to said press-fit part to the second board, wherein the fixed beam and the compliant cantilever beam provide a retention force against a wall of the plated through hole, thereby electrically press-fitting the compliant press-fit pin into the plated through hole, when said press-fit part is inserted into the plated through hole.

20 Claims, 9 Drawing Sheets

COMPLIANT PRESS-FIT PIN HAVING COMPLIANT CANTILEVER BEAM

FIELD OF THE INVENTION

The present invention relates to a compliant press-fit pin; and, more particularly, to the compliant press-fit pin having a compliant cantilever beam for the sake of electrically coupling a daughter plane to a backplane via a plated through hole formed in the backplane.

DESCRIPTION OF THE PRIOR ART

Generally, a one-piece connector has been employed as a connector for connecting a daughter plane to a backplane in a communication system. Further, a two-piece connector has been employed to improve signal processing, signal transmission speed and packaging density.

The two-piece connector includes a solder type of the two-piece connector and a solderless type of the two-piece connector. Because of a disadvantage of the solder type of the two-piece connector, the solderless type of the two-piece connector is preferred.

The solderless type of the two-piece connector includes a rigid body pin and a compliant press-fit pin. The compliant press-fit pin is press-fit into a plated through hole formed in the backplane. The compliant press-fit pin includes C, N, M, S and V types of compliant press-fit pins according to a sectional shaped configuration and an action pin as a division type of the compliant press-fit pin.

However, there is a problem that the conventional compliant press-fit pin is disadvantageous in commercialization where a size of the plated through hole is reduced according to high packing density of the communication system.

SUMMARY OF THE INVENTION

It is, therefore, an object of the present invention to provide a compliant press-fit pin for electrically coupling a daughter board to a backplane via a plated through hole formed in the backplane that is capable of providing optimum insertion force and retention force.

In accordance with an aspect of the present invention, there is provided a compliant press-fit pin for electrically coupling a first board to a second board via a plated through hole formed in the second board, comprising: an upper part for electrically fixing the first board; a lower part for electrically coupling the first board to a third board via the plated through hole formed in the second board; and a press-fit part located between said upper part and said lower part and containing a fixed beam and a compliant cantilever beam, for electrically coupling the first board fixed to said press-fit part to the second board, wherein the fixed beam and the compliant cantilever beam provide a retention force against a wall of the plated through hole, thereby electrically press-fitting the compliant press-fit pin into the plated through hole, when said press-fit part is inserted into the plated through hole.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Figure 1A:
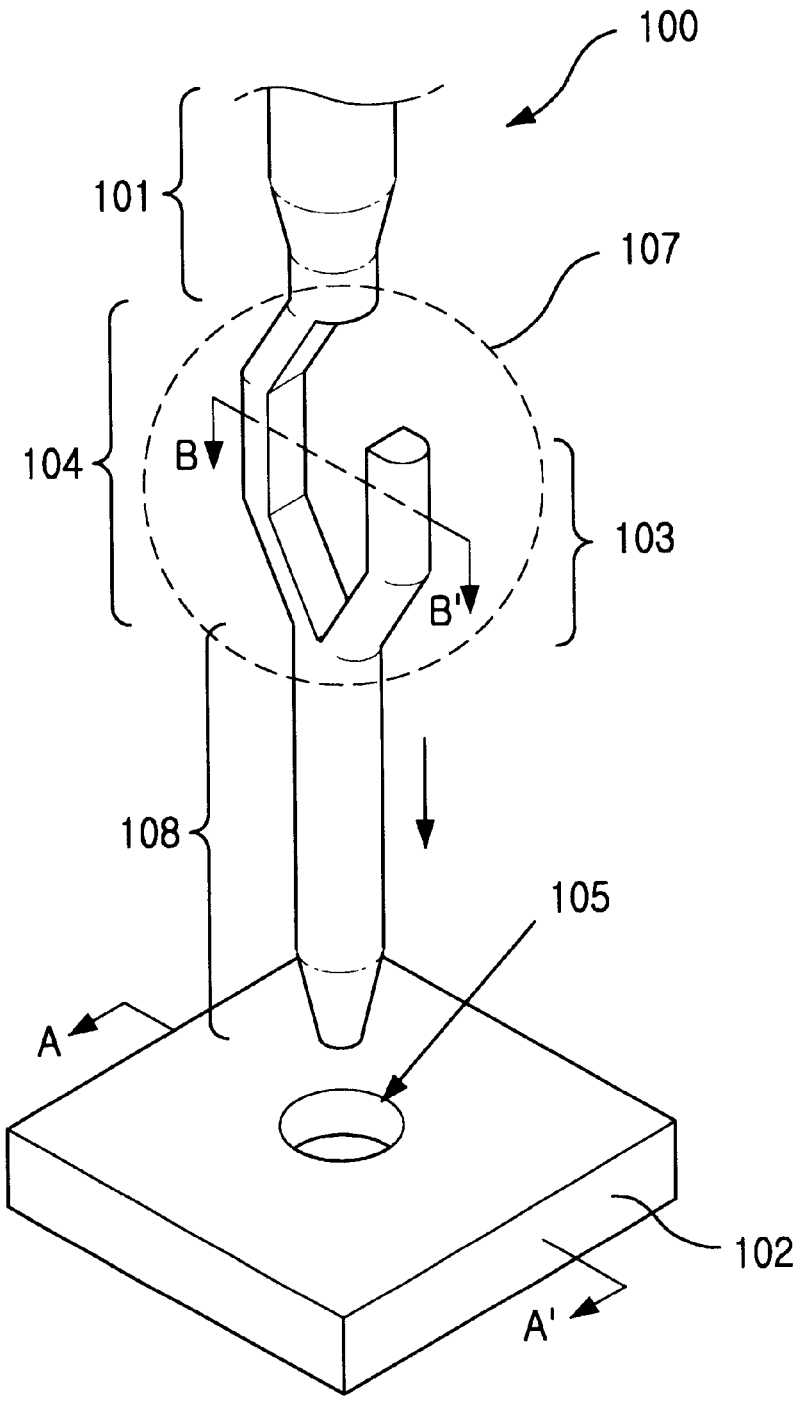
FIG. 1A shows a compliant press-fit pin having a compliant cantilever beam and a backplane in accordance with the present invention.

Referring to FIG. 1A, there is shown a compliant press-fit pin having a compliant cantilever beam and a backplane in accordance with the present invention. A compliant press-fit pin 100 electrically couples a daughter board (not shown) to a backplane 102 via a plated through hole 105 formed in the backplane 102. The compliant press-fit pin 100 includes an upper part 101, a press-fit part 107 and a lower part 108 as a wrap post.

The upper part 101 electrically fixes the daughter board. The press-fit part 107 electrically couples the daughter board fixed to the press-fit part 107 to the backplane 102. The press-fit part 107 is located between the upper part 101 and the lower part 108. The press-fit part 107 contains a fixed beam 104 and a compliant cantilever beam 103. The fixed beam 104 and the compliant cantilever beam 103 provide a retention force against a wall of the plated through hole 105, thereby electrically press-fitting the compliant press-fit pin 100 into the plated through hole 105, when the press-fit part 107 is inserted into the plated through hole 105. The lower part 108 electrically couples the daughter board to another daughter board via the plated through hole 105 formed in the backplane 102.

Figure 1B:
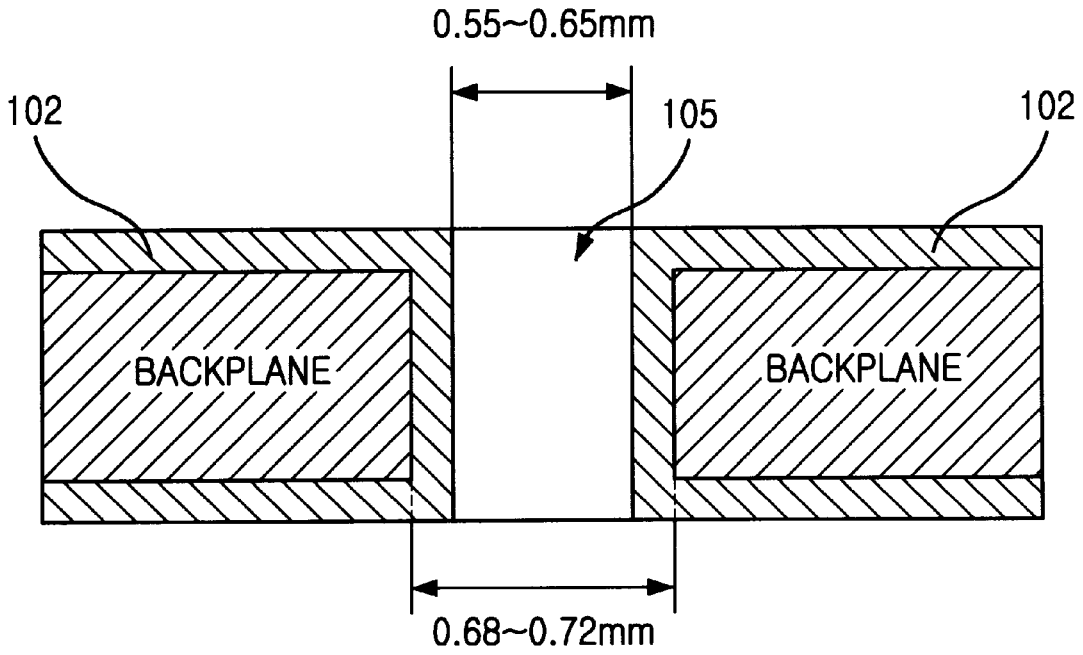
FIG. 1B depicts a sectional view of the backplane taken along a line A–A' shown in FIG. 1A.

Referring to FIG. 1B, there is shown a sectional view of the backplane taken along a line A–A' shown in FIG. 1A. Dimensions of the compliant press-fit pin 101 and the plated through hole 105 are determined by a standard of international electrotechnical commission (IEC). As shown, a diameter of the plated through hole 105 is 0.55 mm to 0.65 mm in a pitch of 2 mm, preferably. Further, a dimension of the press-fit part 107 may be defined by the standard of the IEC. Where the backplane 102 is drilled so that a through hole is formed in the backplane 102, a diameter of the through hole is 0.68 mm to 0.72 mm. The through hole is plated with a material of Copper or a material of a compound metal made up of Copper and Tin/Lead (Sn/Pb) so that the plated through hole 105 is formed in the backplane 102.

Figure 1C:
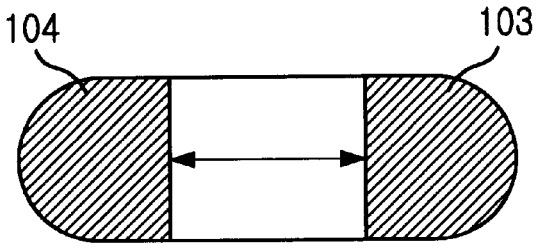
FIGS. 1C and 1D show sectional views of the compliant press-fit pin taken along a line B–B' shown in FIG. 1A.
Figure 1D:
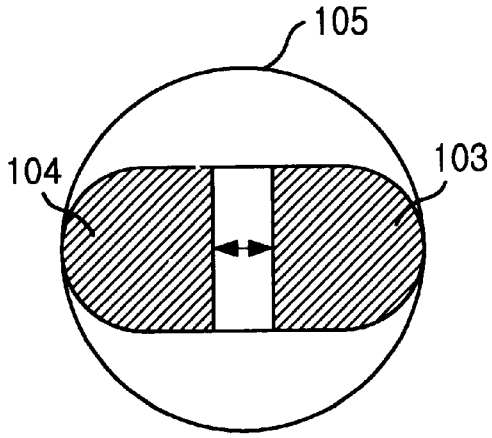

Referring to FIG. 1C, there is shown a sectional view of the compliant press-fit pin taken along a line B–B' shown in FIG. 1A. Referring to FIG. 1D, there is shown a sectional view of the compliant press-fit pin taken along a line B–B' shown in FIG. 1A, when the compliant press-fit pin is press-fitted against a wall of the plated through hole 105.

Figure 2:
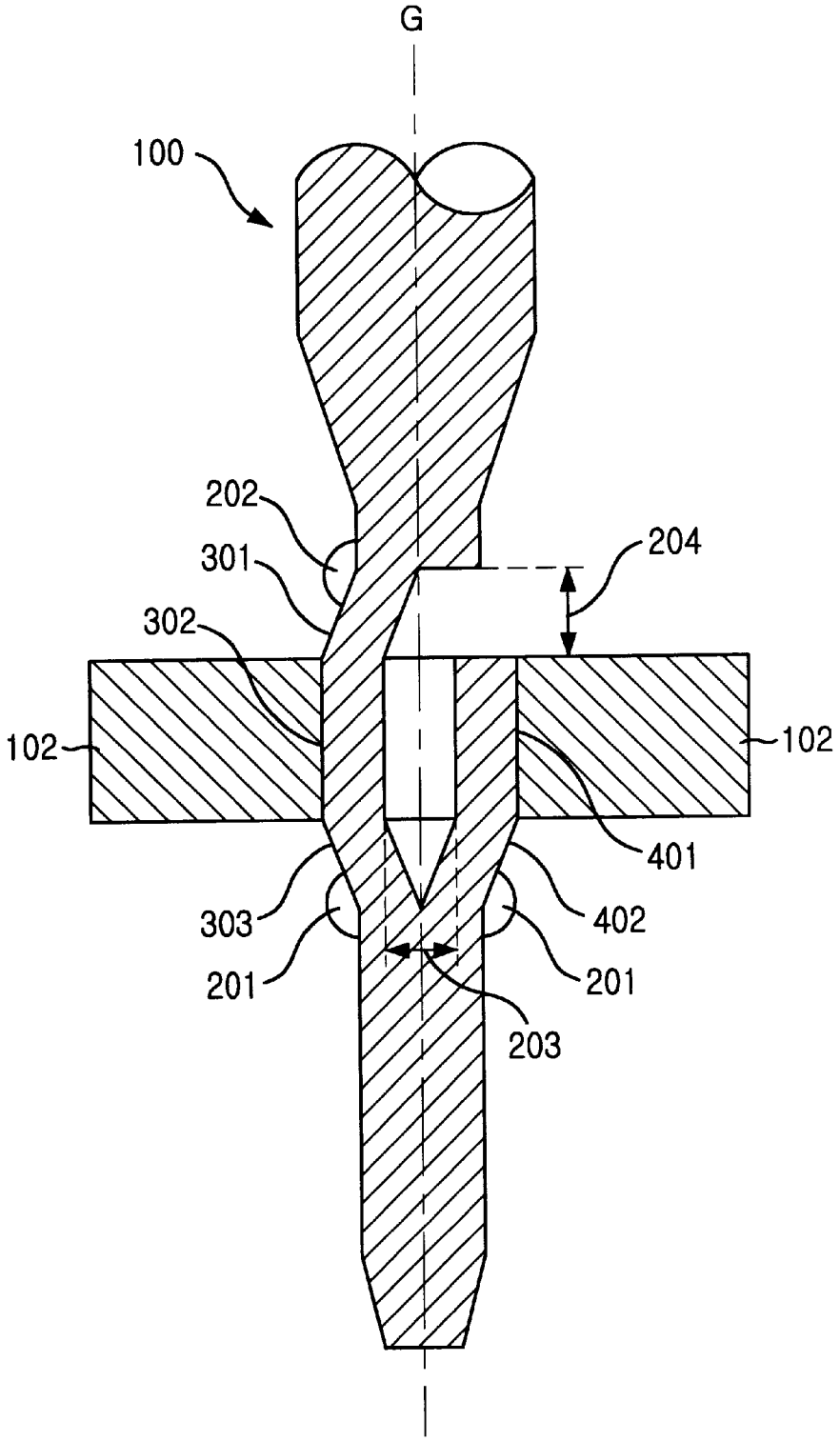
FIG. 2 shows a sectional view of a compliant press-fit pin press-fitted against a wall of the plated through hole shown in FIG. 1A.

Referring to FIG. 2, there is shown a sectional view of a compliant press-fit pin press-fitted against a wall of the plated through hole 105 shown in FIG. 1A.

The fixed beam 104 contained in the press-fit part 107 shown in FIG. 1A includes portions 301, 302 and 303.

The portion 301 is connected to the upper part 101 shown in FIG. 1A at a rear angle 202. The rear angle 202 is formed between the portion 301 and a line G running through a longitudinal axis of the upper part 101.

The portion 302 is connected to the portion 301 and parallel to the line G running through the longitudinal axis of the upper part 101. The portion 302 is in contact with the wall of the plated through hole 105 shown in FIG. 1A when the press-fit part 107 shown in FIG. 1A is inserted into the plated through hole 105.

The portion 303 is connected between the portion 302 and the lower part 108 shown in FIG. 1A at a front angle 201. The front angle 201 is formed between the portion 303 and the line G running through the longitudinal axis of the upper part 101.

The compliant cantilever beam 103 contained in the press-fit part 107 includes portions 401 and 402.

The portion 401 is connected to the portion 402 and parallel to the line G running through the longitudinal axis of the upper part 101. The portion 401 is in contact with the wall of the plated through hole 105 when the press-fit part 107 is inserted into the plated through hole 105.

The portion 402 is connected between the portion 401 and the lower part 108 at the front angle 201. The front angle 201 is formed between the portion 402 and the line G running through the longitudinal axis of the upper part 101.

The fixed beam 104 and the compliant cantilever beam 103 have a thickness of 0.25 mm, respectively. Maximum displacement width between the fixed beam 104 and the compliant cantilever beam 103 is 0.4 mm. The dimension of a reference numeral 204 affects an eccentric displacement.

Further, if the fixed beam 104 and the compliant cantilever beam 103 have a thickness of 0.275 mm, respectively, the displacement width between the fixed beam 104 and the compliant cantilever beam 103 is 0.1 to 0.45 mm. When the compliant press-fit pin 100 has the displacement width of 0.1 mm and the plated through hole 105 has a diameter of 0.6 mm, elastic force of the compliant press-fit pin 100 is 0 kgf. Accordingly, the elastic force of the compliant press-fit pin 100 should be more than 0 kgf.

When the compliant press-fit pin 100 is inserted into the plated through hole 105, insertion force should be not beyond 25 kgf according to the standard of the IEC. When the compliant press-fit pin 100 is withdrawn from the plated through hole 105, withdrawal force should be more than 2 kgf according to the standard of the IEC.

Figure 3A:
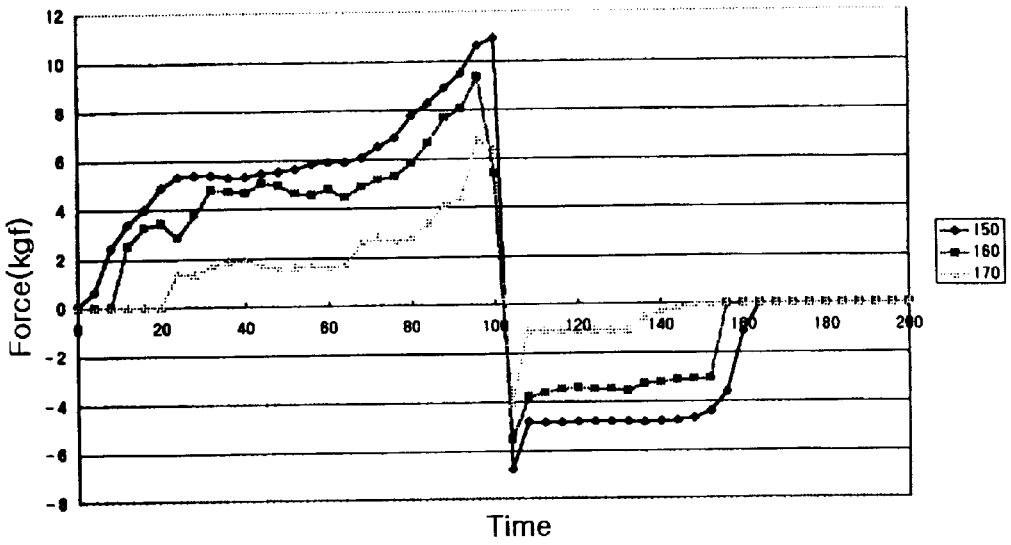
FIGS. 3A to 3C are graphs illustrating insertion and withdrawal force according to a front angle of the compliant press-fit pin shown in FIG. 1A.
Figure 3B:
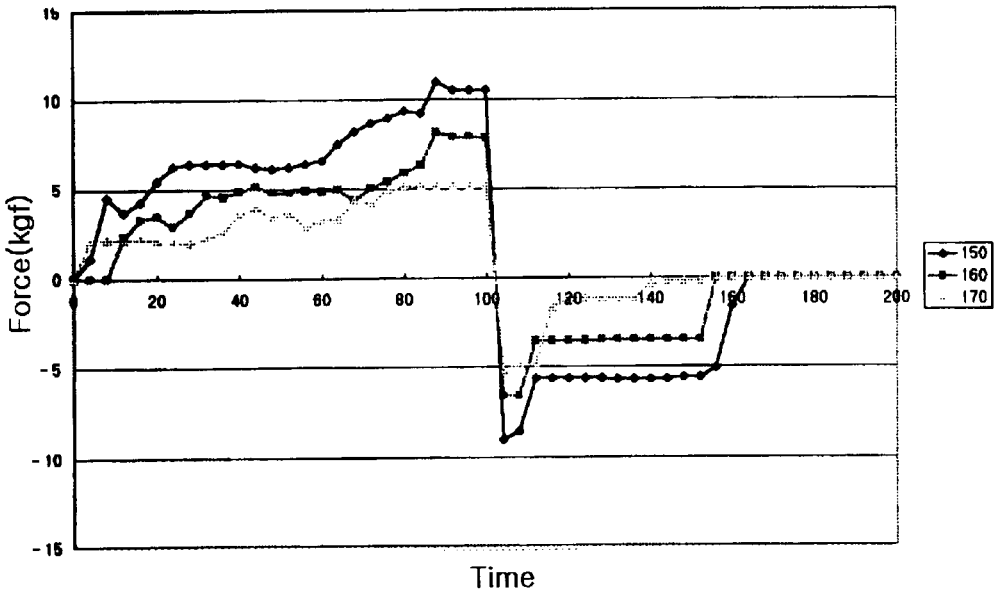
Figure 3C:
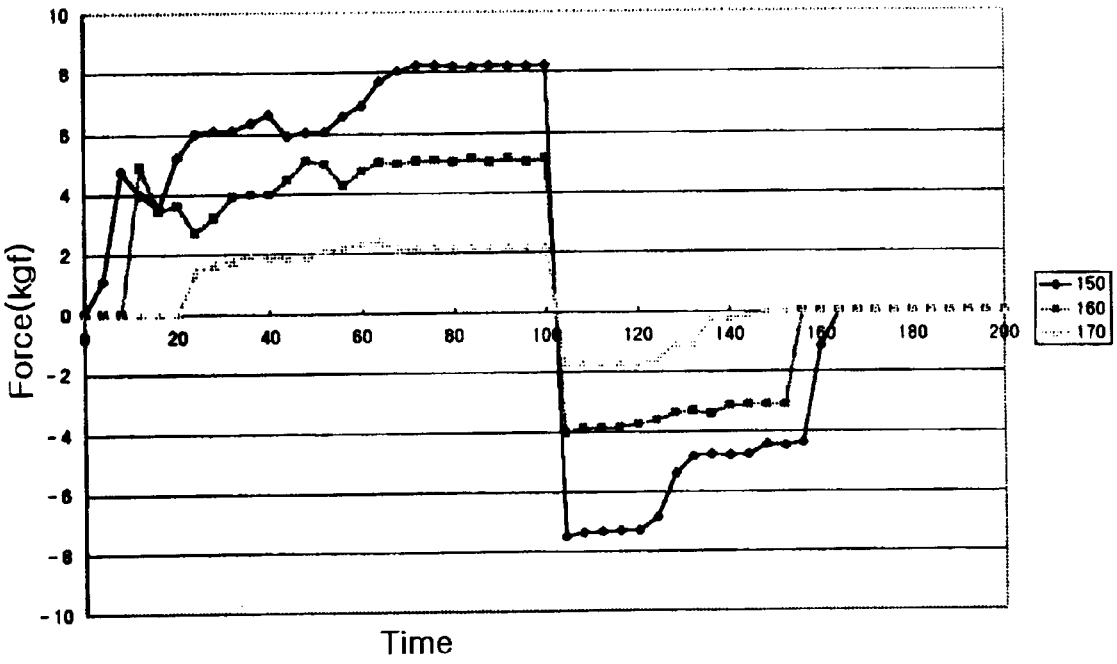

Referring to FIG. 3A, there is shown a graph illustrating insertion and withdrawal force according to a variation of the front angle 201 shown in FIG. 2 where the rear angle 202 shown in FIG. 2 is 150°. As shown, when the front angle 201 and the rear angle 202 are 150°, respectively, strongest insertion and withdrawal force are needed. Referring to FIG. 3B, there is shown a graph illustrating insertion and withdrawal force according to a variation of the front angle 201 shown in FIG. 2 where the rear angle 202 shown in FIG. 2 is 160°. Referring to FIG. 3C, there is shown a graph illustrating insertion and withdrawal force according to a variation of the front angle 201 shown in FIG. 2 where the rear angle 202 shown in FIG. 2 is 170°. The compliant press-fit pin 100 shown in FIG. 1A has the front angle 201 of 150° to 160° so that the compliant press-fit pin 100 is appropriate to the standard of the IEC.

Figure 4A:
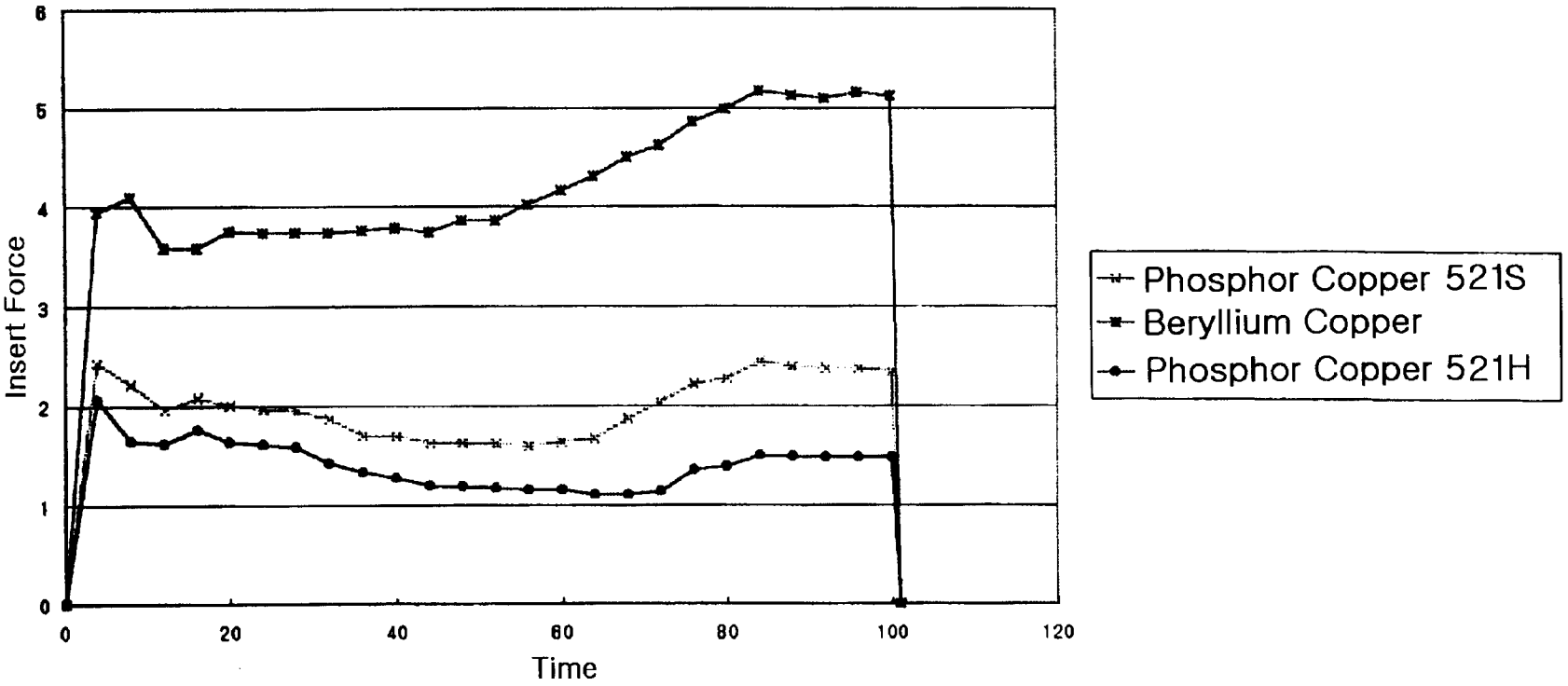
FIGS. 4A and 4B are graphs describing insertion and withdrawal force according to a material of the compliant press-fit pin shown in FIG. 1A.
Figure 4B:
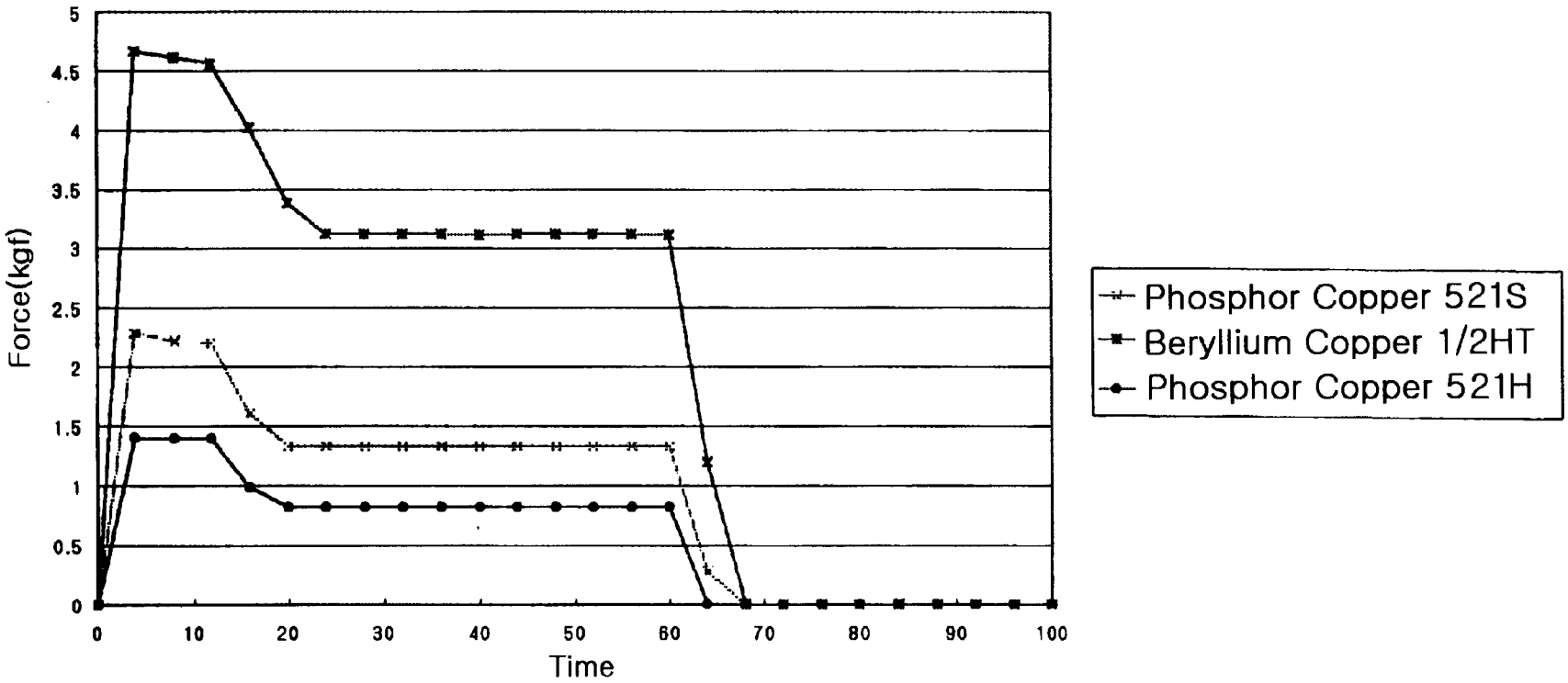
Figure 5:
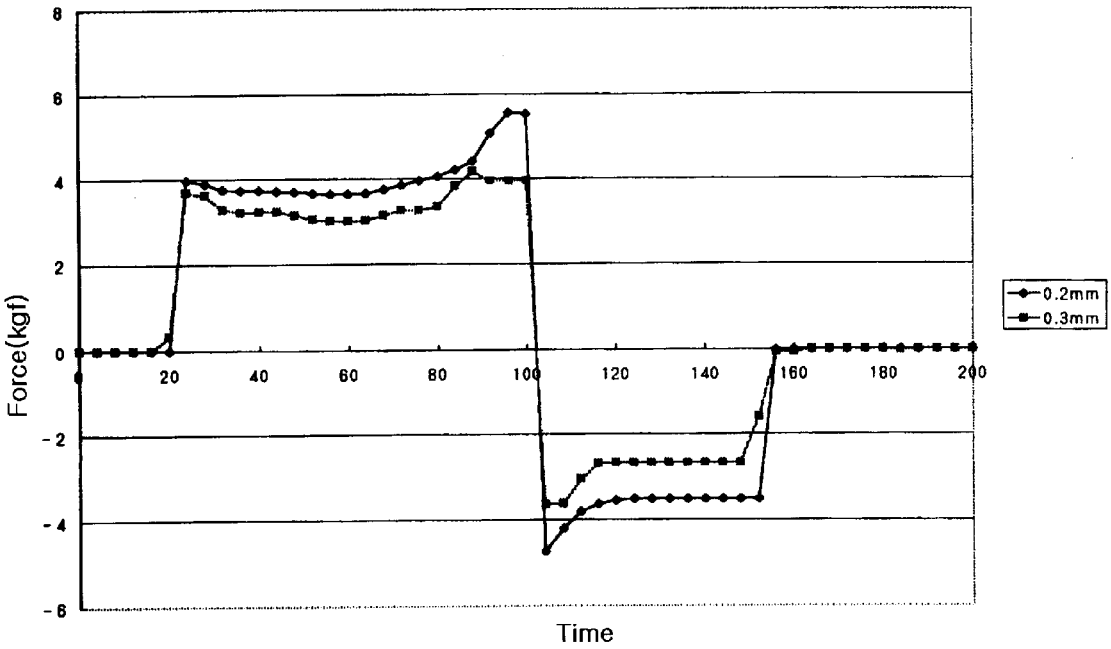
FIG. 5 is a graph depicting insertion and withdrawal force according to displacement width of the compliant press-fit pin shown in FIG. 1A.

Referring to FIGS. 4A and 4B, there is shown a graph describing insertion and withdrawal force according to a material of the compliant press-fit pin shown in FIG. 1A. As shown, in an aspect of an elastic coefficient, Beryllium Copper as a material of the press-fit pin 100 shown in FIG. 1A is preferred. Referring to FIG. 5, there is a graph depicting insertion and withdrawal force according to displacement width of the compliant press-fit pin shown in FIG. 1A.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A compliant press-fit pin for electrically coupling a first board to a second board via a plated through hole formed in the second board, comprising:

an upper part for electrically fixing the first board;

a lower part for electrically coupling the first board to a third board via the plated through hole formed in the second board; and a press-fit part located between said upper part and said lower part and containing a single fixed beam and a compliant cantilever beam, for electrically coupling the first board fixed to said press-fit part to the second board, said single fixed beam alone connecting said upper part to said lower part, wherein the fixed beam and the compliant cantilever beam both provide elasticity and a retention force against a wall of the plated through hole, thereby electrically press-fitting the compliant press-fit pin into the plated through hole, when said press-fit part is inserted into the plated through hole.

2. The compliant press-fit pin as recited in claim 1, wherein the fixed beam contained in said press-fit part includes:

a first portion connected to said upper part at a first predetermined angle, wherein the first predetermined angle is formed between said first portion and a line running through a longitudinal axis of said upper part;

a second portion connected to said first portion and parallel to the line running through the longitudinal axis of said upper part, wherein said second portion is in contact with the wall of the plated through hole when said press-fit part is inserted into the plated through hole; and a third portion connected between said second portion and said lower part at a second predetermined angle, wherein a second predetermined angle is formed between said third portion and the line running through the longitudinal axis of said upper part.

3. The compliant press-fit pin as recited in claim 1, wherein the compliant cantilever beam contained in said press-fit part includes:

a first portion connected to said lower part, wherein a third predetermined angle is formed between said first portion and the line running through the longitudinal axis of said upper part; and a second portion connected to said first portion and parallel to the line running through the longitudinal axis of said upper part, wherein said second portion is in contact with the wall of the plated through hole when said press-fit part is inserted into the plated through hole.

4. The compliant press-fit pin as recited in claim 2, wherein the second predetermined angle between said third portion of the fixed beam and the line running through the longitudinal axis of said upper part is in the range of 150° to 160°.

5. The compliant press-fit pin as recited in claim 3, wherein the third predetermined angle between said first portion of the compliant cantilever beam and the line running through the longitudinal axis of the upper part is in the range of 150° to 160°.

6. The compliant press-fit pin as recited in claim 2, wherein the fixed beam and the compliant cantilever beam have a thickness of approximately 0.25 mm, respectively.

7. The compliant press-fit pin as recited in claim 3, wherein the fixed beam and the compliant cantilever beam have a thickness of approximately 0.25 mm, respectively.

8. The compliant press-fit pin as recited in claim 6, wherein the maximum displacement width between the fixed beam and the compliant cantilever beam is approximately 0.4 mm.

9. The compliant press-fit pin as recited in claim 7, wherein the maximum displacement width between the fixed beam and the compliant cantilever beam is approximately 0.4 mm.

10. The compliant press-fit pin as recited in claim 8, wherein the plated through hole has a diameter of 0.55 mm to 0.65 mm.

11. The compliant press-fit pin as recited in claim 9, wherein the plated through hole has a diameter of 0.55 mm to 0.65 mm.

12. The compliant press-fit pin as recited in claim 10, wherein the material of the compliant press-fit pin includes Beryllium Copper.

13. The compliant press-fit pin as recited in claim 11, wherein the material of the compliant press-fit pin includes Beryllium Copper.

14. A compliant press-fit pin for electrically coupling a first board to a second board via a plated through hole formed in the second board, comprising:

an upper part for electrically fixing the first board;

a lower part for electrically coupling the first board to a third board via the plated through hole formed in the second board; and a press-fit part located between said upper part and said lower part for electrically coupling the first board fixed to said press-fit part to the second board, said press-fit part containing, a fixed beam having a first portion connected to said upper part at a first predetermined angle formed between said first portion and a line running through a longitudinal axis of said upper part, a second portion connected to said first portion and parallel to the line running through the longitudinal axis of said upper part, said second portion being in contact with a wall of the plated through hole when said press-fit part is inserted into the plated through hole, and a third portion connected between said second portion and said lower part at a second predetermined angle formed between said third portion and the line running through the longitudinal axis of said upper part; and a compliant cantilever beam having a first cantilever portion connected to said lower part such that a third predetermined angle is formed between said first cantilever portion and the line running through the longitudinal axis of said upper part, and a second cantilever portion connected only to said first cantilever portion and parallel to the line running through the longitudinal axis of said upper pail, wherein said second cantilever portion is in contact with the wall of the plated through hole when said press-fit part is inserted into the plated through hole, said compliant cantilever beam providing significant elasticity during pin insertion;

wherein the fixed beam and the compliant cantilever beam provide a retention force against the wall of the plated through hole, thereby electrically press-fitting the compliant press-fit pin into the plated through hole, when said press-fit part is inserted into the plated through hole.

15. The compliant press-fit pin as recited in claim 14, wherein the second predetermined angle between said third portion of the fixed beam and the line running through the longitudinal axis of said upper part is in a range of 150° to 160°.

16. The compliant press-fit pin as recited in claim 14, wherein the third predetermined angle between said first cantilever portion of the compliant cantilever beam and the line running through the longitudinal axis of said upper part is in a range of 150° to 160°.

17. The compliant press-fit pin as recited in claim 14, wherein each of the fixed beam and the compliant cantilever beam have a thickness of approximately 0.25 mm, respectively.

18. The compliant press-fit pin as recited in claim 17, wherein a maximum displacement width between the fixed beam and the compliant cantilever beam is approximately 0.4 mm.

19. The compliant press-fit pin as recited in claim 18, wherein the plated through hole has a diameter of approximately 0.55 mm to 0.65 mm.

20. The compliant press-fit pin as recited in claim 19, wherein the compliant press-fit pin is made of a material that includes Beryllium Copper.

* * * * *